US006864631B1

(12) United States Patent
Wedding

(10) Patent No.: US 6,864,631 B1
(45) Date of Patent: Mar. 8, 2005

(54) GAS DISCHARGE DISPLAY DEVICE

(75) Inventor: Donald K Wedding, Toledo, OH (US)

(73) Assignee: Imaging Systems Technology, Toledo, OH (US)

( * ) Notice: Subject to any disclaimer, the term of this patent is extended or adjusted under 35 U.S.C. 154(b) by 0 days.

(21) Appl. No.: 10/270,141

(22) Filed: Oct. 15, 2002

Related U.S. Application Data

(63) Continuation-in-part of application No. 09/967,922, filed on Oct. 2, 2001, now abandoned, which is a continuation of application No. 09/756,230, filed on Jan. 9, 2001, now abandoned.

(60) Provisional application No. 60/175,715, filed on Jan. 12, 2000.

(51) Int. Cl.[7] ..... H01J 17/49

(52) U.S. Cl. ..... 313/587; 313/582; 313/586; 313/485

(58) Field of Search ..... 313/484–487, 313/582–587, 495, 567, 568, 609; 428/402, 402.2

(56) References Cited

U.S. PATENT DOCUMENTS 2,644,113 A 6/1953 Etzkorn
3,499,167 A 3/1970 Baker et al. ..... 315/169
3,559,190 A 1/1971 Bitzer et al. ..... 340/173
3,602,754 A * 8/1971 Pfaender et al. ..... 313/586
3,603,836 A 9/1971 Grier ..... 313/201
3,607,159 A 9/1971 Coxe ..... 65/21
3,646,384 A 2/1972 Lay ..... 313/109.5
3,176,742 A 4/1973 Nakayama et al. ..... 313/182
3,836,393 A 9/1974 Ernsthausen et al. ..... 117/217
3,846,171 A 11/1974 Byrum, Jr. et al. ..... 117/223
3,848,248 A * 11/1974 MacIntyre, Jr. ..... 345/60
3,860,846 A 1/1975 Mayer ..... 313/491
3,886,390 A 5/1975 Maloney et al. ..... 313/217

(List continued on next page.)

FOREIGN PATENT DOCUMENTS

JP 11-238469 8/1999

*Primary Examiner*—Nimeshkumar D. Patel
*Assistant Examiner*—German Colón

(57) ABSTRACT

There is disclosed a gas discharge display device comprised of microspheres containing ionizable gas, photons from the gas discharge within a microsphere exciting a phosphor such that the phosphor emits wavelengths in the visible and/or invisible spectrum. The invention is described in detail with reference to an AC gas discharge (plasma) display.

29 Claims, 5 Drawing Sheets

U.S. PATENT DOCUMENTS 3,886,404 A 5/1975 Kurshashi et al. .... 315/169 TV
3,964,050 A 6/1976 Mayer ..... 340/324
4,035,689 A 7/1977 Ogle et al. ..... 315/169 TV
4,035,690 A 7/1977 Roeber
4,080,597 A 3/1978 Mayer et al. ..... 340/324 M
4,126,807 A 11/1978 Wedding et al. ..... 313/188
4,126,809 A 11/1978 Wedding et al. ..... 313/221
4,233,623 A 11/1980 Pavliscak ..... 358/59
4,303,732 A 12/1981 Torobin ..... 428/333
4,320,418 A 3/1982 Pavliscak ..... 358/240
4,349,456 A 9/1982 Sowman ..... 252/317
4,494,038 A 1/1985 Wedding et al. ..... 313/587
4,532,505 A 7/1985 Holz ..... 340/775
4,563,617 A * 1/1986 Davidson ..... 315/312
4,827,186 A 5/1989 Knauer et al. ..... 313/485
4,926,095 A 5/1990 Shinoda et al. ..... 315/169.4
4,956,577 A * 9/1990 Parker ..... 313/634
5,075,597 A 12/1991 Salavin et al. ..... 315/169.4
5,107,182 A 4/1992 Sano et al. ..... 315/169.4
5,182,489 A 1/1993 Sano ..... 313/485
5,198,479 A 3/1993 Shiobara et al.
5,326,298 A 7/1994 Hotomi
5,448,344 A 8/1995 Kanazawa ..... 315/169.4
5,500,287 A 3/1996 Henderson ..... 428/403
5,501,871 A 3/1996 Henderson ..... 427/160
5,541,479 A 7/1996 Nagakubo ..... 313/586
5,640,068 A 6/1997 Amemiya ..... 313/582
5,661,500 A 8/1997 Shinoda et al. ..... 345/60
5,661,550 A 8/1997 Ko ..... 399/45
5,674,553 A 10/1997 Shinoda et al. ..... 427/88
5,742,122 A 4/1998 Amemiya et al. ..... 313/582
5,786,219 A * 7/1998 Zhang et al. ..... 436/523
6,452,332 B1 * 9/2002 Moore ..... 313/582
6,545,422 B1 * 4/2003 George et al. ..... 315/169.3
6,633,117 B2 * 10/2003 Shinoda et al. ..... 313/484

* cited by examiner

GAS DISCHARGE DISPLAY DEVICE

RELATED APPLICATION

This is a continuation-in-part under 35 USC of 120 of Ser. No. 09/967,922 filed Oct. 2, 2001 which is a continuation of Ser. No. 09/756,230 filed Jan. 9, 2001, ABN with a claim of priority under 35 USC 119(e) of Provisional Application 60/175,715, filed Jan. 12, 2000.

BACKGROUND

Field of the Invention

This invention relates to a gas discharge (plasma) device wherein an ionizable gas is confined within an enclosure and is subjected to sufficient voltage(s) to cause the gas to discharge. This invention particularly relates to the use of microspheres containing ionizable gas in a plasma display panel (PDP).

In a gas discharge plasma display, a single addressable picture element is a cell, sometimes referred to as a pixel. The cell element is defined by two or more electrodes positioned in such a way so as to provide a voltage potential across a gap containing an ionizable gas. When sufficient voltage is applied across the gap, the gas discharges and produces light. In an AC gas discharge plasma display, the electrodes at a cell site are coated with a dielectric. The electrodes are generally grouped in a matrix configuration to allow for selective addressing of each cell or pixel.

To form a display image, several types of voltage pulses may be applied across a plasma display cell gap. These pulses include a write pulse, which is the voltage potential sufficient to ionize the gas at the pixel site. A write pulse is selectively applied across selected cell sites. The ionized gas will produce visible light, or UV light which excites a phosphor to glow. Sustain pulses are a series of pulses that produce a voltage potential across pixels to maintain ionization of cells previously ionized. An erase pulse is used to selectively extinguish ionized pixels.

The voltage at which a pixel will ionize, sustain, and erase depends on a number of factors including the distance between the electrodes, the composition of the ionizing gas, and the pressure of the ionizing gas. Also of importance is the dielectric composition and thickness. To maintain uniform electrical characteristics throughout the display it is desired that the various physical parameters adhere to required tolerances. Maintaining the required tolerance depends on cell geometry, fabrication methods and the materials used. The prior art discloses a variety of plasma display structures, a variety of methods of construction, and a variety of materials.

Examples of gas discharge (plasma) devices contemplated in the practice of this invention include both monochrome (single color) AC plasma displays and multi-color (two or more colors) AC plasma displays.

Examples of monochrome AC gas discharge (plasma) displays contemplated in the practice of this invention are well known in the prior art and include those disclosed in U.S. Pat. No. 3,559,190 issued to Bitzer et al., U.S. Pat. No. 3,499,167 (Baker et al), U.S. Pat. No. 3,860,846 (Mayer) U.S. Pat. No. 3,964,050 (Mayer), U.S. Pat. No. 4,080,597 (Mayer) and U.S. Pat. No. 3,646,384 (Lay) and U.S. Pat. No. 4,126,807(Wedding), all incorporate herein by reference.

Examples of multicolor AC plasma displays contemplated in the practice of this invention are well known in the prior art and include those disclosed in U.S. Pat. No. 4,233,623 issued to Paviiscak, U.S. Pat. No. 4,320,418 (Paviiscak), U.S. Pat. No. 4,827,186 (Knauer, et al.), U.S. Pat. No. 5,661,500 (Shinoda et al.), U.S. Pat. No. 5,674,553 (Shinoda, et al.), U.S. Pat. No. 5,107,182 (Sano et al.), U.S. Pat. No. 5,182,489 (Sano), U.S. Pat. No. 5,075,597 (Salavin et al), U.S. Pat. No. 5,742,122 (Amemiya, et al.), U.S. Pat. No. 5,640,068 (Amemiya et al.), U.S. Pat. No. 5,736,815 (Amemiya), U.S. Pat. No. 5,541,479 (Nagakubi), U.S. Pat. No. 5,745,086 (Weber) and U.S. Pat. No. 5,793,158 (Wedding), all incorporated herein by reference.

In addition, this invention may be practiced in a DC gas discharge (plasma) display, for example as disclosed in U.S. Pat. No. 3,886,390 (Maloney et al.), U.S. Pat. No. 3,886,404 (Kurahashi et al.), U.S. Pat. No. 4,035,689 (Ogle et al.) and U.S. Pat. No. 4,532,505 (Holz et al.), all incorporated herein by reference.

In the practice of this invention, the microspheres may be used in any plasma display panel (PDP) structure. The PDP industry has used two different AC plasma display panel (PDP) structures, the two-electrode columnar discharge structure and the three-electrode surface discharge structure.

The two-electrode columnar discharge display structure is disclosed in U.S. Pat. No. 3,499,167 (Baker et al) and U.S. Pat. No. 3,559,190 (Bitzer et al.) The two-electrode columnar discharge structure is also referred to as opposing electrode discharge, twin substrate discharge, or co-planar discharge. In the two-electrode columnar discharge AC plasma display structure, the sustaining voltage is continuously applied between an electrode on a rear or bottom substrate and an opposite electrode on the front or top viewing substrate. The gas discharge takes place between the two opposing electrodes in between the top viewing substrate and the bottom substrate.

The columnar discharge structure has been widely used in monochrome AC plasma displays that emit orange or red light from a neon gas discharge. Phosphors may be used in a monochrome structure to obtain a color other than neon orange.

In a multi-color columnar discharge (PDP) structure as disclosed in U.S. Pat. No. 5,793,158 (Wedding), phosphor stripes or layers are deposited along the barrier walls and/or on the bottom substrate adjacent to and extending in the same direction as the bottom electrode. The discharge between the two opposite electrodes generates electrons and ions that bombard and deteriorate the phosphor thereby shortening the life of the phosphor and the PDP.

In a two electrode columnar discharge PDP as disclosed by Wedding 158, each light emitting pixel is defined by a gas discharge between a bottom or rear electrode x and a top or front opposite electrode y, each cross-over of the two opposing arrays of bottom electrodes x and top electrodes y defining a pixel or cell.

The three-electrode multi-color surface discharge AC plasma panel structure is widely disclosed in the prior art including U.S. Pat. Nos. 5,661,500 and 5,674,553, both issued to Tsutae Shinoda et al of Fujitsu Limited; U.S. Pat. No. 5,745,086 issued to Larry F. Weber of Plasmaco and Matsushita; and U.S. Pat. No. 5,736,815 issued to Kimio Amemiya of Pioneer Electronic Corporation, all of which are incorporated herein by reference.

In a surface discharge PDP, each light emitting pixel or cell is defined by the gas discharge between two electrodes on the top substrate. In a multi-color RGB display, the pixels may be called sub-pixels or sub-cells. Photons from the discharge of an ionizable gas at each pixel or sub-pixel excite a photoluminescent phosphor that emits red, blue, or green light.

In a three-electrode surface discharge AC plasma display, a sustaining voltage is applied between a pair of adjacent parallel electrodes that are on the front or top viewing substrate. These parallel electrodes are called the bulk sustain electrode and the row scan electrode. The row scan electrode is also called a row sustain electrode because of its dual functions of address and sustain. The opposing electrode on the rear or bottom substrate is a column data electrode and is used to periodically address a row scan electrode on the top substrate. The sustaining voltage is applied to the bulk sustain and row scan electrodes on the top substrate. The gas discharge takes place between the row scan and bulk sustain electrodes on the top viewing substrate.

In a three-electrode surface discharge AC plasma display panel, the sustaining voltage and resulting gas discharge occurs between the electrode pairs on the top or front viewing substrate above and remote from the phosphor on the bottom substrate. This separation of the discharge from the phosphor minimizes electron bombardment and deterioration of the phosphor deposited on the walls of the barriers or in the grooves (or channels) on the bottom substrate adjacent to and/or over the third (data) electrode. Because the phosphor is spaced from the discharge between the two electrodes on the top substrate, the phosphor is subject to less electron bombardment than in a columnar discharge PDP.

RELATED PRIOR ART

This invention relates to the use of microspheres containing an ionizable gas in a gas discharge plasma display.

U.S. Pat. No. 2,644,113 (Etzkorn), incorporated herein by reference, discloses ampoules or hollow glass beads containing luminescent gases that emit a colored light. In one embodiment, the ampoules are used to radiate ultra violet light onto a phosphor external to the ampoule itself. U.S. Pat. No. 3,848,248 (MacIntyre), incorporated herein by reference, discloses the embedding of gas filled beads in a transparent dielectric. The beads are filled with a gas using a capillary. The external shell of the beads may contain phosphor.

U.S. Pat. No. 4,035,690 (Roeber), incorporated herein by reference, discloses a plasma panel display with a plasma forming gas encapsulated in clear glass spheres. Roeber used commercially available glass spheres containing gases such as air, $SO_2$ or $CO_2$ at pressures of 0.2 to 0.3 atmosphere, Roeber discloses the removal of these residual gases by heating the glass spheres at an elevated temperature to drive out the gases through the heated walls of the glass sphere. Roeber obtains different colors from the glass spheres by filling each sphere with a gas mixture which emits a color upon discharge and/or by using glass sphere made from colored glass.

Japanese Patent 11238469A, published Aug. 31, 1999, by Tsuruoka Yoshiaki of Dainippon discloses a plasma display panel containing a gas capsule. The gas capsule is provided with a ruptural part which ruptures when it absorbs a laser beam.

SUMMARY OF THE INVENTION

This invention comprises the use of microspheres and an ionizable gas in a gas discharge (plasma) display wherein photons from the gas discharge within a microsphere excite a phosphor such that the phosphor emits light in the visible and/or invisible spectrum. The invention is described in detail hereinafter with reference to a Plasma Display Panel (PDP) in an AC gas discharge (plasma) display.

DESCRIPTION OF THE INVENTION

In accordance with the practice of this invention, the gas discharge space within a gas discharge plasma display device comprises one or more hollow microspheres, each hollow microsphere containing an ionizable gas mixture capable of forming a gas discharge when a sufficient voltage is applied to opposing electrodes in close proximity to the microsphere.

Figure 1:
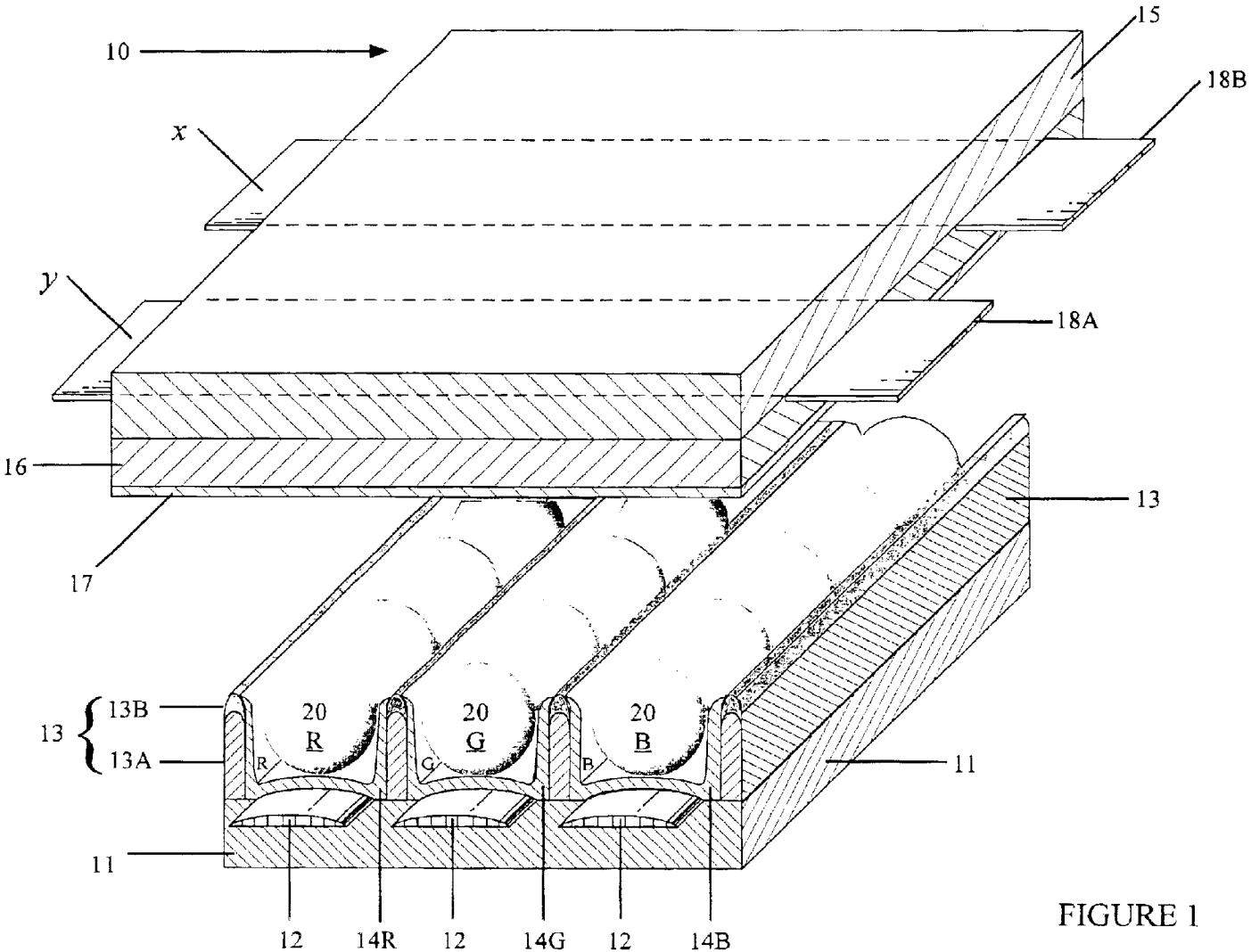
FIG. 1 shows a prospective view of an AC gas discharge (plasma) display with microspheres.
Figure 2:
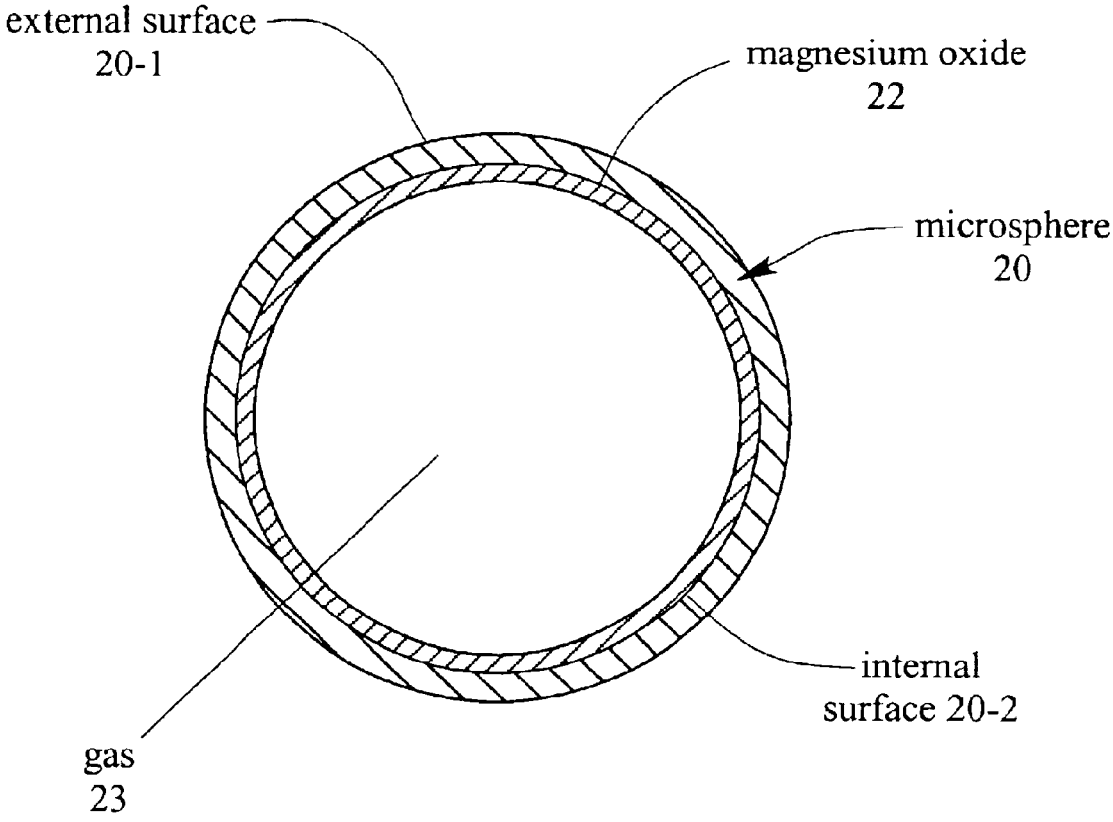
FIG. 2 shows a cross-section view of a microsphere embodiment used in FIG. 1.

FIG. 1 shows microspheres 20R, 20G, 20B of this invention positioned in a gas discharge plasma display panel structure 10 similar to the structure illustrated and described in FIG. 2 of U.S. Pat. No. 5,661,500 (Shinoda et al.) which is cited above and incorporated herein by reference. The panel structure 10 has a bottom or rear glass substrate 11 with electrodes 12, barriers 13, phosphor 14R, 14G, 14B, and microspheres 20R, 20G, 20B. Each microsphere 20R, 20G, 20B, contains an ionizable gas.

The top substrate 15 is transparent for viewing and contains y electrode 18A and x electrode 18B, dielectric layer 16 covering the electrodes 18A and 18B, and dielectric protective layer 17 covering the surface of dielectric 16.

Each electrode 12 on the bottom substrate 11 is called a column data electrode. The y electrode 18A on the top substrate 15 is the row scan electrode and the x electrode 18B on the top substrate 15 is the bulk sustain electrode. The gas discharge is initiated by voltages applied between a bottom column data electrode 12 and a top y row scan electrode 18A. The sustaining of the resulting discharge is done between the electrode pair of the top y row scan electrode 18A and the top x bulk sustain electrode 18B.

The basic electronic architecture for applying voltages to the three electrodes 12, 18A, 18B is disclosed in U.S. Pat. Nos. 5,541,618 and 5,724,054 issued to Shinoda of Fujitsu and U.S. Pat. No. 5,446,344 issued to Yoshikazu Kanazawa of Fujitsu. This basic architecture is widely used in the industry for addressing and sustaining AC gas discharge (plasma) displays and has been labeled by Fujitsu as ADS (Address Display Separately). In addition to ADS, other suitable architectures are known in the art and are available as disclosed herein for addressing and sustaining the electrodes 12, 18A, and 18B of FIG. 1 and FIG. 4.

Phosphor 14R emits red luminance when excited by photons from the gas discharge within the microsphere 20R.

Phosphor 14G emits green luminance when excited by photons from the gas discharge within the microsphere 20G.

Phosphor 14B emits blue luminance when excited by photons for the gas discharge within the microsphere 20B.

The barriers 13 have a top portion 13B containing a black colorant for improved contrast. The lower portion barrier 13A may be white, black, transparent or translucent.

FIG. 2 shows a cross-sectional view of a microsphere 20 used in FIG. 1 with external surface 20-1 and internal surface 20-2, an internal magnesium oxide layer 22, and ionizable gas 23.

Magnesium oxide is a secondary electron emission substance which emits one or more secondary electrons when it is bombarded, struck, or impacted by another electron. Other secondary electron materials may be substituted for magnesium oxide or used in combination with magnesium oxide. Magnesium oxide increases the ionization level through secondary electron emission that in turn leads to reduced gas discharge voltages. The magnesium oxide layer 22 on the inner surface 20B of the microsphere 20 is separate from the phosphor which is located outside of the microsphere 20. The thickness of the magnesium oxide is about 250 Angstrom Units to 10,000 Angstrom Units (Å).

Magnesium oxide is susceptible to contamination. To avoid contamination, gas discharge (plasma) displays are assembled in clean rooms that are expensive to construct and maintain. In traditional plasma panel production, magnesium oxide is typically applied to an entire substrate surface. At this point the magnesium oxide is vulnerable to contamination. In contrast, with the magnesium oxide layer 22 on the inside surface 20B of the microsphere 20, exposure of the magnesium oxide to contamination is minimized.

The magnesium oxide layer 22 may be applied to the inside of the microsphere 20 by using a process similar to the technique disclosed by U.S. Pat. No. 4,303,732(Torobin). In this process, magnesium vapor is incorporated as part of the ionizable gases introduced into the microsphere while the microsphere is at an elevated temperature.

Figure 3:
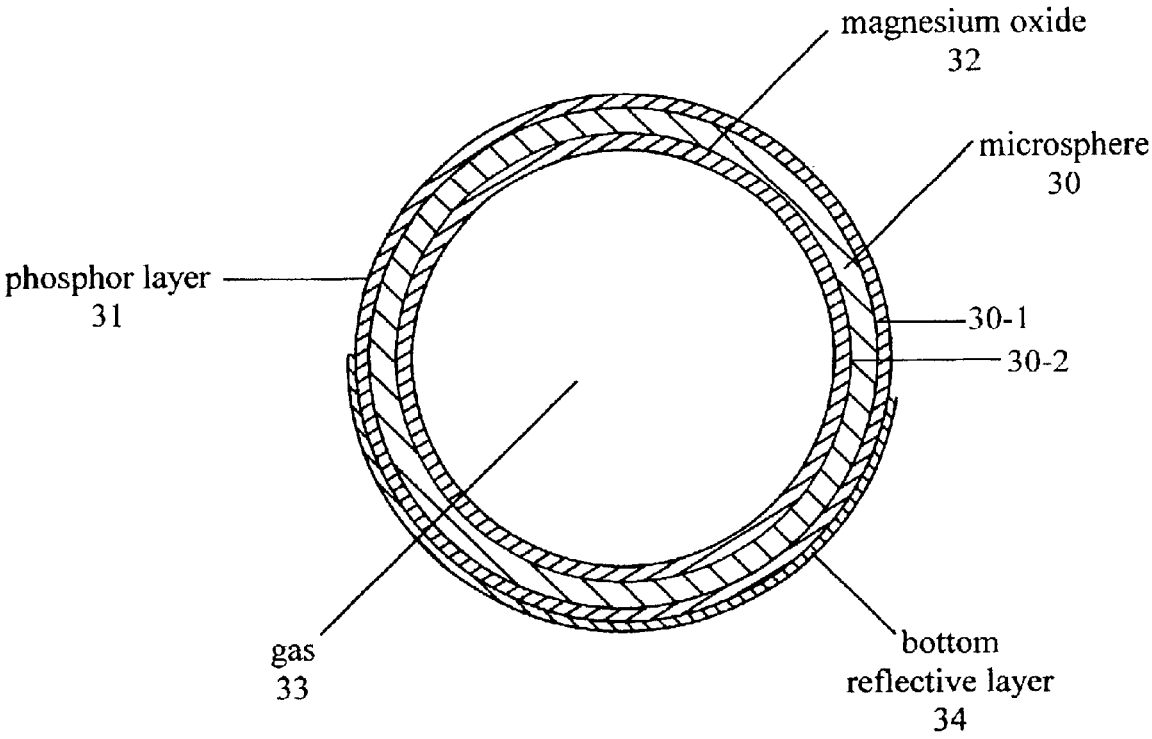
FIG. 3 shows a cross-section view of another microsphere embodiment.

FIG. 3 shows a cross-sectional view of a best embodiment of the microsphere 30 with external surface 30-1 and internal surface 30-2, an external phosphor layer 31, internal magnesium oxide layer 32, ionizable gas 33, and an external bottom reflective layer 34.

The bottom reflective layer 34 is optional and, when used, will typically cover about half of the phosphor layer 31 on the external surface 30A. This bottom reflective layer 34 will reflect light upward that would otherwise escape and increase the brightness of the display.

Figure 4:
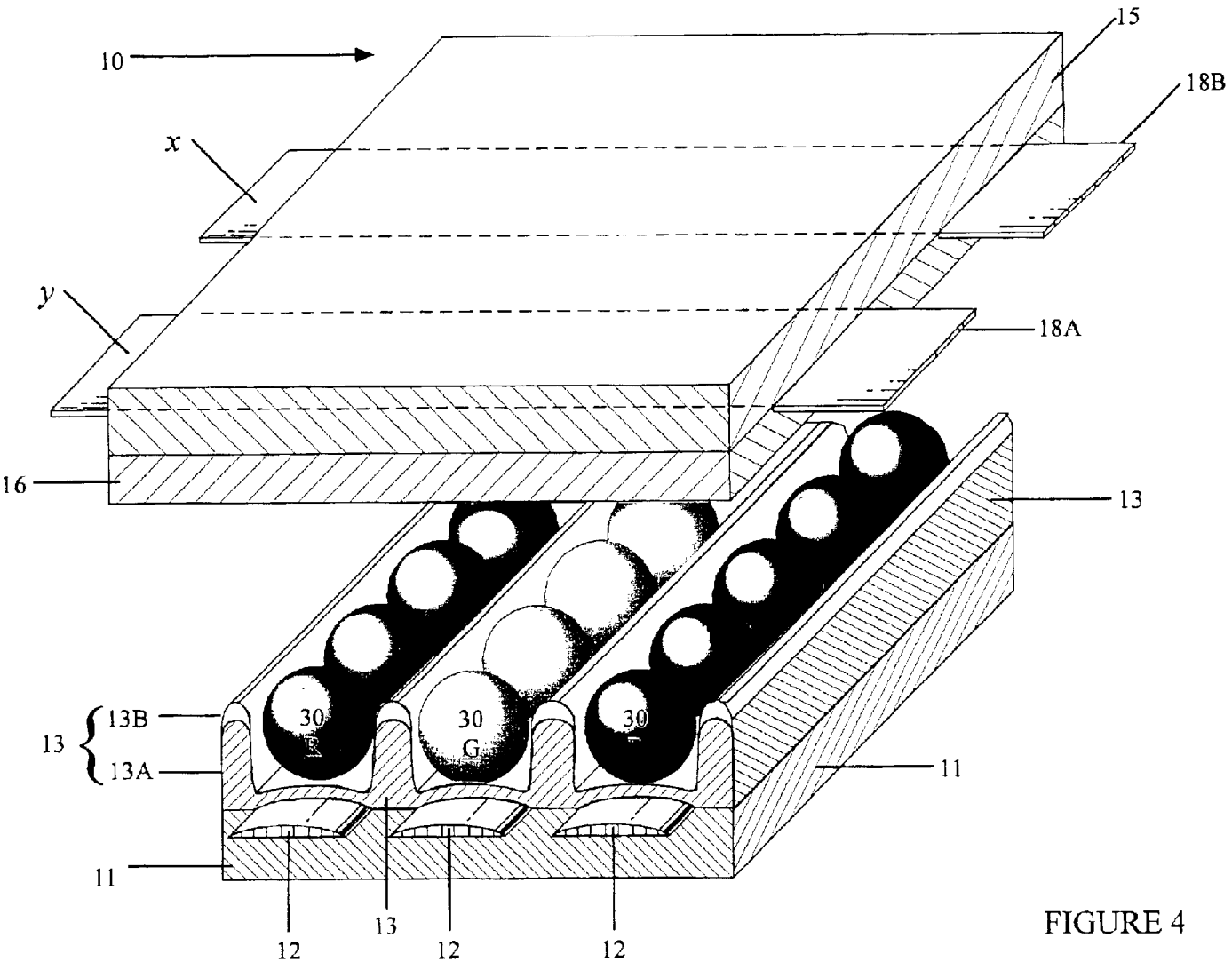
FIG. 4 shows a prospective view of a variation of the display structure in FIG. 1.

FIG. 4 is a variation of FIG. 1 and shows another embodiment of this invention. In this embodiment, the microsphere 30 is used in the plasma display structure of FIG. 4. The protective layer 17 and the phosphor 14R, 14G, 14B as shown in the FIG. 1 structure are omitted form the FIG. 4 structure. In this FIG. 4 structure, the microsphere 30 of FIG. 3 has an internal magnesium oxide layer 32 and an external phosphor layer 31 which is excited by photons from the gas discharge within the microsphere. The phosphor 31 is selected to emit the desired visible or invisible wavelength of light, e.g., red, blue, or green in a multicolor plasma display. The phosphor may be a layer or coating over all or part of the external surface of the microsphere 30. The thickness of the phosphor ranges from about 2 to 40 microns, typically about 5 to 15 microns. The thickness may be optimized for each phosphor.

The electrodes 12, 18A, and 18B are in sufficient close proximity to the microspheres so that a gas discharge results inside the microsphere. Direct contact of electrodes with the spheres may be appropriate. Although FIGS. 1 and 4 are shown with a single row of microspheres in each channel or groove formed by the barriers 13, there may be a plurality rows or layers of microspheres randomly or selectively arranged in stacks in the channel or groove.

The geometric arrangement of the microspheres as illustrated in FIGS. 1 and 4 is red-green-blue (RGB). Other geometric arrangements may be utilized in the practice of this invention.

Figure 5:
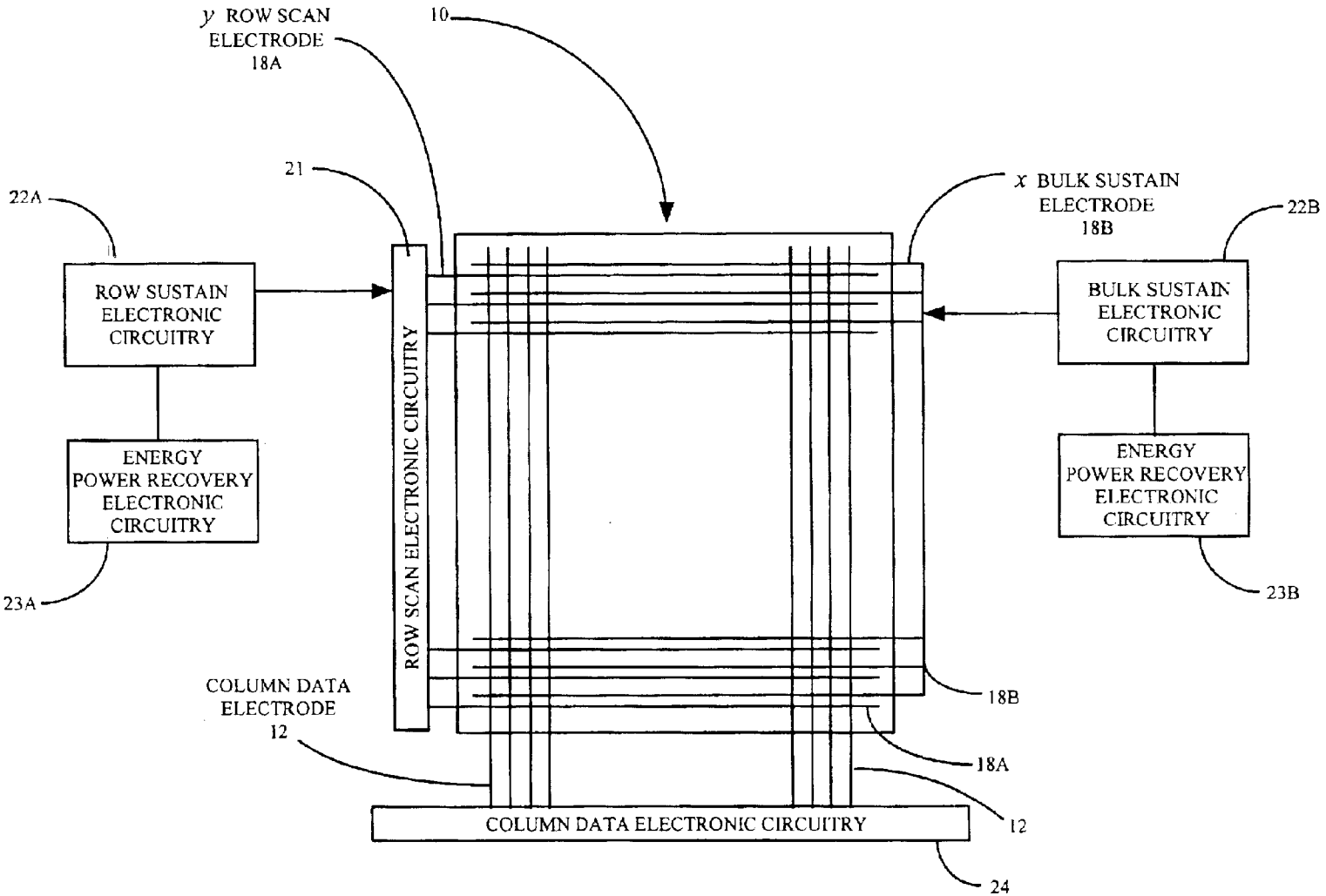
FIG. 5 shows a block diagram for driving an AC gas discharge plasma display as shown in FIGS. 1 and 4.

FIG. 5 shows display panel 10 of FIG. 1 or 4 with electronic circuitry 21 for the y row scan electrodes 18A, bulk sustain electronic circuitry 22B for x bulk sustain electrode 18B and column data electronic circuitry 24 for the column data electrodes 12.

There is also shown row sustain electronic circuitry 22A with an energy power recovery electronic circuit 23A. There is also shown energy power recovery electronic circuitry 23B for the bulk sustain electronic circuitry 22B.

A basic electronics architecture for addressing and sustaining a surface discharge AC plasma display is called Address Display Separately (ADS). The ADS architecture may be used for a monochrome or multicolor display. The ADS architecture is disclosed in a number of Fujitsu patents including U.S. Pat. Nos. 5,541,618 and 5,724,054, both issued to Shinoda of Fujitsu Ltd., Kawasaki, Japan. Also see U.S. Pat. No. 5,446,344 issued to Yoshikazu Kanazawa of Fujitsu and Shinoda et al 500 referenced above. ADS has become a basic electronic architecture widely used in the AC plasma display industry for the manufacture of monitors and television.

Fujitsu ADS architecture is commercially used by Fujitsu and is also widely used by competing manufacturers including Matsushita and others. ADS is disclosed in U.S. Pat. No. 5,745,086 issued to Weber of Plasmaco and Matsushita. See FIGS. 2, 3, 11 of Weber 086. The ADS method of addressing and sustaining a surface discharge display as disclosed in U.S. Pat. Nos. 5,541,618 and 5,724,054 issued to Shinoda of Fujitsu sustains the entire panel (all rows) after the addressing of the entire panel. The addressing and sustaining are done separately and are not done simultaneously.

Another electronic architecture is called Address While Display (AWD). The AWD electronics architecture was first used during the 1970s and 1980s for addressing and sustaining monochrome PDP. In AWD architecture, the addressing (write and/or erase pulses) are interspersed with the sustain waveform and may include the incorporation of address pulses onto the sustain waveform. Such address pulses may be on top of the sustain and/or on a sustain notch or pedestal. See for example U.S. Pat. No. 3,801,861 (Petty et al) and U.S. Pat. No. 3,803,449 (Schmersal). FIGS. 1 and 3 of the Shinoda 054 ADS patent discloses AWD architecture as prior art.

The AWD electronics architecture for addressing and sustaining monochrome PDP has also been adopted for addressing and sustaining multi-color PDP. For example, Samsung Display Devices Co., Ltd., has disclosed AWD and the superimpose of address pulses with the sustain pulse. Samsung specifically labels this as address while display (AWD). See High-Luminance and High-Contrast HDTV PDP with Overlapping Driving Scheme, J. Ryeom et al, pages 743 to 746, Proceedings of the Sixth International Display Workshops, IDW 99, Dec. 1–3, 1999, Sendai, Japan. AWD is also disclosed in U.S. Pat. No. 6,208,081 issued to Yoon-Phil Eo and Jeong-duk Ryeom of Samsung. LG Electronics Inc. has disclosed a variation of AWD with a Multiple Addressing in a Single Sustain (MASS) in U.S. Pat. No. 6,198,476 issued to Jin-Won Hong et al of LG Electronics. Also see U.S. Pat. No. 5,914,563 issued to Eun-Cheol Lee et al of LG Electronics.

The electronics architecture used in FIGS. 1,4 and 5 is ADS as described in Shinoda 618 and 054. In addition, other architectures as described herein and known in the prior art may be utilized.

Examples of energy recovery architecture and circuits are well known in the prior art. These include U.S. Pat. Nos.

4,772,884 (Weber et al.) 4,866,349 (Weber et al.), 5,081,400 (Weber et al.), 5,438,290 (Tanaka), 5,642,018 (Marcotte), 5,670,974 (Ohba et al.), 5,808,420 (Rilly et al.) and 5,828,353 (Kishi et al.), all incorporated herein by reference. These may be used with the ADS or other architectures in FIGS. 1 4, and 5.

Slow rise slopes or ramps may be used in the practice of this invention with ADS or other architectures. The prior art discloses slow rise slopes or ramps for the addressing of AC plasma displays. The early patents include U.S. Pat. Nos. 4,063,131 and 4,087,805 issued to John Miller of Owens-Ill.; U.S. Pat. No. 4,087,807 issued to Joseph Miavecz of Owens-Ill.; and U.S. Pat. Nos. 4,611,203 and 4,683,470 issued to Tony Criscimagna et al of IBM.

An architecture for a slow ramp reset voltage is disclosed in U.S. Pat. No. 5,745,086 issued to Larry F. Weber of Plasmaco and Matsushita, incorporated herein by reference. Weber 086 discloses positive or negative ramp voltages that exhibit a slope that is set to assure that current flow through each display pixel site remains in a positive resistance region of the gas's discharge characteristics. The slow ramp architecture is disclosed in FIG. 11 of Weber 086 in combination with the Fujitsu ADS. PCT Patent Application WO 00/30065 filed by Junichi Hibino et al of Matsushita also discloses architecture for a slow ramp reset voltage and is incorporated herein by reference.

Artifact reduction techniques may be used in the practice of this invention. The PDP industry has used various techniques to reduce motion and visual artifacts in a PDP display. Pioneer of Tokyo, Japan has disclosed a technique called CLEAR for the reduction of false contour and related problems. See Development of New Driving Method for AC-PDPs by Tokunaga et al of Pioneer *Proceedings of the Sixth International Display Workshops*, IDW 99, pages 787–790, Dec. 1–3, 1999, Sendai, Japan. Also see European Patent Applications EP 1 020 838 A1 by Tokunaga et al of Pioneer, incorporated herein by reference. The CLEAR technique uses an algorithm and waveform to provide ordered dither gray scale in small increments with few motion or visual artifacts. CLEAR comprises turning on pixels followed by selective erase.

The microspheres may be constructed of any suitable material. In one embodiment of this invention, the microsphere is made of glass, ceramic, quartz, or like amorphous and/or crystalline materials including mixtures of such.

In other embodiments it is contemplated that the microsphere may be made of plastic, metal, metalloid, or other such materials including mixtures or combinations thereof.

Glasses made of inorganic compounds of metals and metalloids are contemplated, such as oxides, silicates, borates, and phosphates of titanium, zirconium, hafnium, gallium, silicon, aluminum, lead, zinc, boron, magnesium and so forth.

In one specific embodiment of this invention, the microsphere is made of an aluminate silicate glass or contains a layer of aluminate silicate glass. When the ionizable gas mixture contains helium, the aluminate silicate glasses are especially beneficial in preventing the escaping of helium.

It is also contemplated that the microsphere shell may be made of other glasses including lead silicates, lead phosphates, lead oxides, borosilicates, alkali silicates, aluminum oxides, soda lime glasses, and pure vitreous silica.

For secondary electron emission a microsphere may be made in whole or in part from one or more materials such as magnesium oxide having a sufficient Townsend coefficient of secondary emission. These include inorganic compounds of magnesium, calcium, strontium, barium, gallium, lead, and the rare earths especially lanthanum, cerium, actinium, and thorium. The contemplated inorganic compounds include oxides, silicates, nitrides, carbides, borides, and other inorganic compounds of the above and other elements.

The use of secondary electron materials in a plasma display is disclosed in U.S. Pat. No. 3,716,742 issued to Nakayama et al. The use of Group IIa compounds including magnesium oxide is disclosed in U.S. Pat. Nos. 3,836,393 and 3,846,171. The use of rare earth compounds in an AC plasma display is disclosed in U.S. Pat. Nos. 4,126,807; 4,126,809; and 4,494,038, all issued to Wedding et al. Lead oxide may also be used as a secondary electron material In the practice of this invention, the microsphere may contain the secondary electron emission material such as magnesium oxide in any form. In one embodiment, the microsphere contains the secondary electron emission material on part or all of the internal surface of a microsphere. The secondary electron emission material may also be contained on the external surface of the microsphere. The entire microsphere may be made of a secondary electronic material such as magnesium oxide.

A secondary electron material such as magnesium oxide may also be dispersed or suspended inside the microsphere as particles within the ionizable gas. These particles may be added with the gas or added before or after the microsphere is filled with gas.

The phosphor particles may also be dispersed or suspended in the gas, or may be affixed to the inner or external surface of the microsphere. In one embodiment, phosphor particles and particles of a secondary electron emission material such as magnesium oxide are dispersed or suspended within the ionizable gas inside the microsphere.

In another embodiment, both the secondary electron emission material and phosphor are applied to the inner surface of the microsphere.

The hollow microspheres may be formed and filled with an ionizable gas mixture as disclosed in U.S. Pat. No. 5,500,287 issued to Timothy M. Henderson which is incorporated herein by reference.

In Henderson 287, the hollow microspheres are formed by dissolving a permeant gas (or gases) into glass frit particles. The gas permeated frit particles are then heated at a high temperature sufficient to blow the frit particles into hollow microspheres containing the permeant gases.

In Henderson 287, the gases may be subsequently out-permeated and evacuated from the hollow sphere as described in step D in column 3 of Henderson. In the practice of this invention, a portion of the gas or gases is not out-permeated and is retained within the hollow microsphere to provide a hollow microsphere containing an ionizable gas.

U.S. Pat. No. 5,501,871 (Henderson) also describes the formation of hollow microspheres and is incorporated herein by reference.

Other methods for forming hollow microspheres are disclosed in the prior art including U.S. Pat. No. 4,303,732 (Torobin), U.S. Pat. No. 3,607,169, (Coxe), and U.S. Pat. No. 4,349,456 (Sowman), U.S. Pat. No. 3,848,248 (Macintyre), and U.S. Pat. No. 4,035,690 (Roeber), all incorporated herein by reference.

The hollow microsphere(s) as used in the practice of this invention contain(s) one or more ionizable gas components. As used herein, ionizable gas or gas means one or more gas components. In the practice of this invention, the gas is typically selected from a mixture of the rare gases of neon, argon, xenon, krypton, helium, and/or radon. The rare gas may be a Penning gas mixture. Other gases are contemplated including nitrogen, $CO_2$, mercury, halogens, excimers, oxygen, hydrogen, and tritium ($T^3$).

In one embodiment, a two-component gas mixture (or composition) is used such as a mixture of argon and xenon, argon and helium, xenon and krypton, xenon and helium, neon and argon, neon and xenon, neon and helium, and neon and krypton.

Specific two-component gas mixtures (compositions) include about 5 to 90% atoms of argon with the balance xenon.

Another two-component gas mixture is a mother gas of neon containing 0.05 to 15% atoms of xenon, argon, or krypton. This can also be a three-component, four-component gas, or five-component gas by using small quantifies of an additional gas or gasses selected from xenon, argon, krypton, and/or helium.

In another embodiment, a three-component ionizable gas mixture is used such as a mixture of argon, xenon, and neon wherein the mixture contains at least 5% to 80% atoms of argon, up to 15% xenon, and the balance neon. The xenon is present in a minimum amount sufficient to maintain the Penning effect. Such a mixture is disclosed in U.S. Pat. No. 4,926,095 (Shinoda et al.), incorporated herein by reference.

Other three-component gas mixtures include argon-helium-xenon; krypton-neon-xenon; and krypton-helium-xenon.

In one embodiment there is used a high concentration of helium with the balance selected from one or more gases of neon, argon, xenon, and nitrogen as disclosed in U.S. Pat. No. 6,285,129 (Park), incorporated herein by reference.

A high concentration of xenon may also be used with one or more other gases as disclosed in U.S. Pat. No. 5,770,921 (Aoki et al), incorporated herein by reference.

In the prior art, gas discharge (plasma) displays are operated with the ionizable gas at a pressure below atmospheric. Gas pressures above atmospheric are not used because of structural problems. Higher gas pressures above atmospheric may cause the display substrates to separate, especially at elevations of 4000 feet or more above sea level. Such separation may also occur between a substrate and a viewing envelope or dome in a single substrate or monolithic plasma panel structure described hereinafter.

The gas pressure inside of the hollow sphere may be less than atmospheric. The typical sub-atmospheric pressure is about 150 to 760 Torr. However, pressures above atmospheric may be used depending upon the structural integrity of the microsphere.

In one embodiment of this invention, the gas pressure inside of the microsphere is less than atmospheric, about 150 to 760 Torr, typically about 350 to 650 Torr.

In another embodiment of this invention, the gas pressure inside of the microsphere is greater than atmospheric. Depending upon the structural strength of the microsphere, the pressure above atmospheric may be about 1 to 250 atmospheres (760 to 190,000 Torr) or greater. Higher gas pressures increase the luminous efficiency of the plasma display.

One or more microspheres is positioned inside of a gas discharge (plasma) display device. As disclosed and illustrated in the gas discharge display patents cited above and incorporated herein by reference, the microspheres may be positioned in one or more channels or grooves of a plasma display structure as disclosed in Shinoda 500, 553, or Wedding 158. The microspheres may also be positioned within a cavity, well, or hollow of a plasma display structure as disclosed by Knauer 186. One or more hollow microspheres containing the ionizable gas is located within the display panel structure in close proximity to opposing electrodes.

The opposing electrodes may be of any geometric shape or configuration. In one embodiment the opposing electrodes are opposing arrays of electrodes, one array of electrodes being transverse or orthogonal to an opposing array of electrodes. The electrode in each opposing array can be parallel, zig zag, serpentine, or like pattern as typically used in dot-matrix gas discharge (plasma), displays. The use of split or divided electrodes is contemplated as disclosed in U.S. Pat. No. 3,603,836 (Grier). The electrodes are of any suitable conductive metal or alloy including gold, silver, aluminum, or chrome-copper-chrome. If a transparent electrode is used on the viewing surface, this is typically indium tin oxide (ITO) or tin oxide with a conductive side or edge bus bar of silver. Other conductive bus bar materials may be used such as gold, aluminum, or chrome-copper-chrome.

The electrodes in each opposing transverse array are transverse to the electrodes in the opposing array so that each electrode in each array forms a crossover with an electrode in the opposing array, thereby forming a multiplicity of crossovers. Each crossover of two opposing electrodes forms a discharge point or cell. At least one hollow microsphere containing ionizable gas is positioned in the gas discharge (plasma) display device at the intersection of two opposing electrodes. When an appropriate voltage potential is applied to an opposing pair of electrodes, the ionizable gas inside of the microsphere at the crossover is energized and a gas discharge occurs. Photons of light in the visible and/or invisible range are emitted by the gas discharge. Neon produces visible light (neon orange) whereas the other rare gases emit light in the non-visible ultraviolet range.

The photons of light pass through the shell or wall of the microsphere and excite a phosphor located outside of the microsphere. In one embodiment contemplated in the practice of this invention, a layer, coating, or particles of phosphor is (are) located on the exterior wall of the microsphere. The phosphor may also be located on the side wall(s) of the channel, groove, cavity, well, hollow or like structure of the discharge space.

The gas discharge within the channel, groove, cavity, well or hollow produces photons that excite the phosphor such that the phosphor emits light in a range visible to the human eye. Typically this is red, blue, or green light. However, phosphors may be used which emit other light such as white, pink, or yellow light. In some embodiments of this invention, the emitted light may not be visible to the human eye.

In prior art AC plasma displays as disclosed in Wedding 158, the phosphor may be located on the wall(s) or side(s) of the barriers that form the channel, groove, cavity, well, or hollow, The phosphor may also be located on the bottom of the channel, or groove as disclosed by Shinoda et al 500 or at the bottom of the cavity, well, or hollow as disclosed by Knauer et al 186.

In one embodiment of this invention, microspheres are positioned within the channel, groove, cavity, well, or hollow, such that photons from the gas discharge within the microsphere causes the phosphor along the wall(s) or side(s) or at the bottom of the channel, groove, cavity, well, or hollow, to emit light.

The microspheres may be geometrically shaped to fit into such channels, grooves, cavities, wells, or hollows. As shown in FIGS. 1 and 4, the microspheres may be spherical. However, other geometric shapes and configurations may be used.

In another embodiment of this invention, phosphor is located on the outside surface of each microsphere as shown in FIG. 3. In this embodiment, the outside surface is at least partially covered with phosphor that emits light when excited by photons from the gas discharge within the microsphere.

In another embodiment, phosphor particles are dispersed and/or suspended within the ionizable gas inside each microsphere. In such embodiment the phosphor particles are sufficiently small such that most of the phosphor particles remain suspended within the gas and do not precipitate or otherwise substantially collect on the inside wall of the microsphere. The mean diameter of the dispersed and/or suspended phosphor particles is less than about 1 micron, typically less than 0.1 micron. Larger particles can be used depending on the size of the microsphere.

In the practice of this invention the microsphere may be color tinted or constructed of materials that are color tinted with red, blue, green, yellow, or like pigments. This is disclosed in Roeber 690 cited above. The gas discharge may also emit color light of different wavelengths as disclosed in Roeber 690.

The use of tinted materials and/or gas discharges emitting light of different wavelengths may be used in combination with the above described phosphors and the light emitted therefrom. Optical filters may also be used in combination with selected phosphors.

The present gas filling techniques used in the manufacture of gas discharge (plasma) display devices comprise introducing the gas mixture through an aperture into the device. This is a gas injection hole. The manufacture steps typically include heating and baking out the assembled device (before gas fill) at a high-elevated temperature under vacuum for 2 to 12 hours. The vacuum is obtained via external suction through a tube inserted in the aperture.

The bake out is followed by back fill of the device with an ionizable gas introduced through the tube and aperture. The tube is then sealed-off.

This bake out and gas fill process is the major production bottleneck in the manufacture of gas discharge (plasma) display devices, requiring substantial capital equipment and a large amount of process time.

For color AC plasma display panels of 40 to 50 inches in diameter, the bake out and vacuum cycle may be up to 30 hours per panel or over 30 million hours per year for a manufacture facility producing over 1 million plasma display panels per year.

The gas-filled microspheres used in this invention can be produced in large economical volumes and added to the gas discharge (plasma) display device without the necessity of bake out and gas process capital equipment. The savings in capital equipment cost and operations costs are substantial.

The microspheres are conveniently added to the gas discharge space between opposing electrodes before the device is sealed. An aperture and tube can be used for bake out if needed, but the costly gas fill operation is eliminated.

The presence of the microspheres inside of the display device also adds structural support and integrity to the device. The present color AC plasma displays of 40 to 50 inches are fragile with a high breakage rate in shipment and handling.

The microspheres may be of any suitable volumetric shape or geometric configuration including but not limited to spherical, oblate spheroid, prolate spheroid, capsular, bullet shape, pear and/or tear drop. In an oblate spheroid, the diameter at the polar axis is flattened and is less than the diameter at the equator. In a prolate spheroid, the diameter at the equator is less than the diameter at the polar axis such that the overall shape is elongated.

The size of the microspheres used in the practice of this invention may vary over a wide range. In a gas discharge display, the average diameter of a microsphere may range from about 1 mil to 20 mils (where one mil equals 0.001 inch) or about 25 microns to 500 microns, typically about 150 to 300 microns. Microspheres can be manufactured up to 2000 microns (about 80 mils) in diameter or greater. The thickness of the wall of each hollow microsphere must be sufficient to retain the gas inside, but thin enough to allow passage of photons emitted by the gas discharge. The wall thickness of plasma panel microspheres should be kept as thin as practical to minimize ultraviolet (uv) absorption, but thick enough to retain sufficient strength so that the microspheres can be easily handled and pressurized. The microsphere wall thickness is generally less than about 10% of the diameter for the microsphere, typically 1 to 5%.

The diameter of the microspheres may be varied for different phosphors such that the cell or pixel structure is asymmetric instead of symmetric. Thus for a gas discharge display having phosphors which emit red, green, and blue light in the visible range, the microspheres for the red phosphor may have an average diameter less than the average diameter of the microspheres for the green or blue phosphor. Typically the average diameter of the red phosphor microspheres is about 80 to 95% of the average diameter of the green phosphor microspheres.

The average diameter of the blue phosphor microspheres may be greater than the average diameter of the red or green phosphor microspheres. Typically the average microsphere diameter for the blue phosphor is about 105 to 125% of the average microsphere diameter for the green phosphor and about 110 to 155% of the average diameter of the red phosphor.

In another embodiment using a high brightness green phosphor, the red and green microsphere may be reversed such that the average diameter of the green phosphor microsphere is about 80 to 95% of the average diameter of the red phosphor microsphere. In this embodiment, the average diameter of the blue microsphere is 105 to 125% of the average microsphere diameter for the red phosphor and about 110 to 155% of the average diameter of the green phosphor.

The red, green, and blue microspheres may also have different size diameters so as to enlarge voltage margin and improve luminance uniformity as disclosed in U.S. patent application Publication 200210041157 Al (Heo), incorporated herein by reference. The widths of the corresponding electrodes for each RBG microsphere may also be of different dimensions such that the electrode is wider or more narrow for a selected phosphor.

Photoluminescent phosphor may be located on all or part of the external surface of the microspheres or on all or part of the internal surface of the microspheres. The phosphor may also be particles dispersed or floating within the gas. In one embodiment contemplated for the practice of this invention, the phosphor is on the external surface of the microsphere as shown in FIG. 3.

The photoluminescent phosphor is excited by ultraviolet (UV) photons from the gas discharge and emits light in the visible range such as red, blue, or green light. Phosphors may be selected to emit light of other colors such as white, pink, or yellow. The phosphor may also be selected to emit light in non-visible ranges of the spectrum. Optical filters may be selected and matched with different phosphors.

Green Phosphor

A green light-emitting phosphor may be used alone or in combination with other light-emitting phosphors such as blue or red. Phosphor materials which emit green light include $Zn_2SiO_4$:Mn, ZnS:Cu, ZnS:Au, ZnS:Al, ZnO:Zn, CdS:Cu, CdS:$Al_2$, $Cd_2O_2S$:Tb, and $Y_2O_2S$:Tb.

In one mode and embodiment of this invention using a green light-emitting phosphor, there is used a green light-emitting phosphor selected from the zinc orthosilicate phosphors such as $ZnSiO_4$:$Mn^{2+}$. Green light emitting zinc orthosilicates including the method of preparation are disclosed in U.S. Pat. No. 5,985,176 (Rao) which is incorporated herein by reference. These phosphors have a broad emission in the green region when excited by 147 nm and 173 nm (nanometers) radiation from the discharge of a xenon gas mixture.

In another mode and embodiment of this invention there is used a green light-emitting phosphor which is a terbium activated yttrium gadolinium borate phosphor such as (Gd, Y) $B0_3$:$Tb^{3+}$. Green light-emitting borate phosphors including the method of preparation are disclosed in U.S. Pat. No. 6,004,481 (Rao) which is incorporated herein by reference.

In another mode and embodiment there is used a manganese activated alkaline earth aluminate green phosphor as disclosed in U.S. Pat. No. 6,423,248 (Rao), peaking at 516 nm when excited by 147 and 173 nm radiation from xenon. The particle size ranges form 0.05 to 5 microns. Rao 248 is incorporated herein by reference.

Terbium doped phosphors may emit in the blue region especially in lower concentrations of terbium. For some display applications such as television, it is desirable to have a single peak in the green region at 543 nm. By incorporating a blue absorption dye in a filter, any blue peak can be eliminated.

Green light-emitting terbium-activated lanthanum cerium orthophosphate phosphors are disclosed in U.S. Pat. No. 4,423,349 (Nakajima et al) which is incorporated herein by reference. Green light-emitting lanthanum cerium terbium phosphate phosphors are disclosed in U.S. Pat. No. 5,651, 920 which is incorporated herein by reference.

Green light-emitting phosphors may also be selected form the trivalent rare earth ion-containing aluminate phosphors as disclosed in U.S. Pat. No. 6,290,875 (Oshio et al).

Blue Phosphor

A blue light-emitting phosphor may be used alone or in combination with other light-emitting phosphors such as green or red. Phosphor materials which emit blue light include ZnS:Ag, ZnS:Cl, and Csl:Na.

In a preferred mode and embodiment of this invention, there is used a blue light-emitting aluminate phosphor. An aluminate phosphor which emits blue visible light is divalent europium ($Eu^{2+}$) activated Barium Magnesium Aluminate (BAM) represented by $BaMgAl_{10}O_{17}$:$Eu^{2+}$. BAM is widely used as a blue phosphor in the PDP industry.

BAM and other aluminate phosphors which emit blue visible light are disclosed in U.S. Pat. No. 5,611,959 (Kijima et al) and U.S. Pat. No. 5,998,047 (Bechtel et al), both incorporated herein by reference. The aluminate phosphors may also be selectively coated as disclosed by Bechtel et al. 047.

Blue light-emitting phosphors may be selected from a number of divalent europium-activated aluminates such as disclosed in U.S. Pat. No. 6,096,243 (Oshio et al) incorporated herein by reference.

In another mode and embodiment of this invention, the blue light-emitting phosphor is thulium activated lanthanum phosphate with trace amounts of $Sr^{2+}$ and/or $Li^{+}$. This exhibits a narrow band emission in the blue region peaking at 453 nm when excited by 147 nm and 173 nm radiation from the discharge of a xenon gas mixture. Blue light-emitting phosphate phosphors including the method of preparation are disclosed in U.S. Pat. No. 5,989,454 (Rao) which is incorporated herein by reference.

In a best mode and embodiment of this invention using a blue-emitting phosphor, a mixture or blend of blue emitting phosphors is used such as a blend or complex of about 85 to 70% by weight of a lanthanum phosphate phosphor activated by trivalent thulium ($Tm^{3+}$), $Li^{+}$, and an optional amount of an alkaline earth element ($AE^{2+}$) as a coactivator and about 15 to 30% by weight of divalent europium-activated BAM phosphor or divalent europium-activated Barium Magnesium, Lanthanum Aluminated (BLAMA) phosphor. Such a mixture is disclosed in U.S. Pat. No. 6,187,225 (Rao), incorporated herein by reference.

Blue light-emitting phosphors also include $ZnO.Ga_2O_3$ doped with Na or Bi. The preparation of these phosphors is disclosed in U.S. Pat. Nos. 6,217,795 (Yu et al) and 6,322, 725 (Yu et al), both incorporated herein by reference.

Other blue light-emitting phosphors include europium activated strontium chloroapatite and europium-activated strontium calcium chloroapatite.

Red Phosphor

A red light-emitting phosphor may be used alone or in combination with other light-emitting phosphors such as green or blue. Phosphor materials which emit red light include $Y_2O_2S$:Eu and $Y_2O_3S$:Eu.

In a best mode and embodiment of this invention using a red-emitting phosphor, there is used a red light-emitting phosphor which is an europium activated yttrium gadolinium borate phosphors such as (Y,Gd)$BO_3$:$Eu^{3+}$ The composition and preparation of these red-emitting borate phosphors is disclosed in U.S. Pat. No. 6,042,747 (Rao) and U.S. Pat. No. 6,284,155 (Rao), both incorporated herein by reference.

These europium activated yttrium, gadolinium borate phosphors emit an orange line at 593 nm and red emission lines at 611 and 627 nm when excited by 147 nm and 173 nm UV radiation from the discharge of a xenon gas mixture. For television (TV) applications, it is preferred to have only the red emission lines (611 and 627 nm). The orange line (593 nm) may be minimized or eliminated with an external optical filter.

A wide range of red-emitting phosphors are used in the PDP industry and are contemplated in the practice of this invention including europium-activated yttrium oxide.

Other Phosphors

There also may be used phosphors other than red, blue, green such as a white light-emitting phosphor, pink light-emitting phosphor or yellow light-emitting phosphor. These may be used with an optical filter.

Phosphor materials which emit white light include calcium compounds such as $3Ca_3(PO_4)_2CaF$:Sb, $3Ca_3(PO_4)_2$.CaF:Mn, $3Ca_3(PO_4)_2$.CaCl:Sb, and $3Ca_3(PO_4)_2$.CaCl:Mn.

White-emitting phosphors are disclosed in U.S. Pat. No. 6,200,496 (Park et al) incorporated herein by reference.

Pink-emitting phosphors are disclosed in U.S. Pat. No. 6,200,497 (Park et al) incorporated herein by reference. Phosphor material which emits yellow light include ZnS:Au.

In one embodiment of this invention it is contemplated using a phosphor to convert infrared radiation to visible light. This is referred to in the literature as an up-conversion phosphor. The up-conversion phosphor is typically used as a layer in combination with a phosphor which converts UV radiation to visible light. An up-conversion phosphor is disclosed in U.S. Pat. No. 6,265,825 (Asano) incorporated herein by reference.

The phosphor thickness is sufficient to absorb the UV, but thin enough to emit light with minimum attenuation. Typically the phosphor thickness is about 2 to 40 microns, preferably about 5 to 15 microns.

The dispersed or floating particles within the gas are typically spherical or needle shaped having an average size of about 0.01 to 5 microns.

The photoluminescent phosphor is excited by UV in the range of 50 to 400 nanometers. The phosphor may have a protective layer or coating which is transmissive to the excitation UV and the emitted visible light. Such include aluminium oxide or silica. Protective coatings are disclosed in Wedding 158.

Because the ionizable gas is contained within a multiplicity of microspheres, it is possible to provide a custom gas at a custom pressure in each microsphere for each phosphor.

In the prior art, it is necessary to select an ionizable gas mixture and gas pressure that is optimum for all phosphors used in the device such as red, blue, and green phosphors. However, this requires trade-offs because a particular gas may be optimum for a particular green phosphor, but less desirable for red or blue phosphors. In addition, tradeoffs are required for the gas pressure.

In the practice of this invention, an optimum gas mixture and an optimum gas pressure may be provided for each of the selected phosphors. Thus the gas mixture and gas pressure inside the microspheres may be optimized with a custom gas mixture and a custom gas pressure, each or both optimized for each phosphor emitting red, blue, green, white, pink, or yellow light. The diameter and the wall thickness of the microsphere can also be adjusted and optimized for each phosphor. Depending upon the Paschen Curve (pd v. voltage) for the ionizable gas mixture, the operating voltage may be decreased by optimized changes in the pressure and diameter.

This invention has been described with reference to a plasma display panel structure having opposing substrates as disclosed in Wedding 158, and Shinoda et al 500. It may also be practiced in a so-called single substrate or monolithic plasma display panel structure having one substrate with or without a top or front viewing envelope or dome.

Single-substrate or monolithic plasma display panel structures are disclosed by U.S. Pat. Nos. 3,860,846 (Mayer), 3,964,050 (Mayer), and 3,646,384 (Lay), all cited above and incorporated herein by reference.

In one embodiment of this invention, the microspheres are positioned within a single-substrate or monolithic gas discharge structure that has a flexible or bendable substrate.

The practice of this invention is not limited to flat surface displays. The microspheres may be positioned or located on a conformal surface or substrate so as to conform to a predetermined shape such as a curved surface, round shape, or multiple sides.

In the practice of this invention, the microspheres may be positioned and spaced in an AC gas discharge plasma display structure so as to utilize and take advantage of the positive column of the gas discharge. The positive column is described in U.S. Pat. No. 6,184,848 (Weber) and is incorporated herein by reference.

The microspheres may be sprayed, stamped, pressed, poured, screen-printed, or otherwise applied to a surface. The surface may contain an adhesive or sticky surface.

Although this invention has been disclosed and described above with reference to dot matrix gas discharge displays, it may also be used in an alphanumeric gas discharge display using segmented electrodes. This invention may also be practiced in AC or DC gas discharge displays including hybrid structures of both AC and DC gas discharge.

This invention may also be practiced in other displays technologies including Field Emission Displays (FED), electrophoretic displays, and Organic EL or Organic LED (OLED).

As disclosed herein, this invention is not to be limited to the exact forms shown and described because changes and modifications may be made by one skilled in the art within the scope of the following claims.

What is claimed is:

1. In a gas discharge display device, the improvement wherein the device is comprised of a multiplicity of microspheres, each microsphere containing an ionizable gas, secondary electron emission material and phosphor, said phosphor being inside of the microsphere, electrodes in proximity to each microsphere, and electronic circuitry means for providing voltages to selected electrodes to cause discharge of the gas within a selected microsphere so as to provide photons for the exciting of the phosphor and the emission of light.

2. The invention of claim 1 wherein the device contains phosphors which emit red, blue, green, white, pink, or yellow light when excited by photons from the discharge of the gas within a microsphere.

3. The invention of claim 2 wherein the gas pressure of the gas inside of each microsphere is optimized for the composition of the ionizable gas, the selected phosphor, and the diameter of the microsphere.

4. The invention of claim 1 wherein the microspheres are within one or more channels, grooves, cavities, wells, or hollows of the gas discharge display device.

5. The invention of claim 1 wherein the ionizable gas contains phosphor particles.

6. The invention of claim 1 wherein phosphor is located on the internal surface of the microsphere.

7. The invention of claim 1 wherein the electronic circuitry comprises Address Display Separately.

8. The invention of claim 1 wherein the electronic circuitry includes a slow ramp reset voltage.

9. The invention of claim 1 wherein the electronic circuitry includes an artifact reduction technique.

10. In an AC gas discharge display device, the improvement wherein the device is composed of a multiplicity of microspheres filled with an ionizable gas mixture, each microsphere containing a secondary electron emission material and phosphor which emits light when excited by photons from the discharge of the gas within the microsphere, said phosphor being inside of the microsphere, and electronic architecture for providing sufficient voltages to cause discharge of the gas within a microsphere so as to provide photons to excite the phosphor and the emission of light.

11. The invention of claim 10 wherein the electronic architecture is Address Display Separately.

12. The invention of claim 10 wherein the electronic architecture includes a slow ramp reset voltage.

13. The invention of claim 10 wherein the electronic architecture utilizes an artifact reduction technique.

14. The invention of claim 10 wherein the device contains phosphors which emit red, blue, green, white, pink, or yellow light when excited by photons from the discharge of the gas within a microsphere.

15. The invention of claim 14 wherein the gas mixture and the gas pressure inside of each microsphere are optimized for each selected phosphor.

16. The invention of claim 10 wherein the microspheres are within one or more channels, grooves, cavities, wells, or hollows of the gas discharge display device.

17. The invention of claim 10 wherein the ionizable gas contains phosphor particles.

18. The invention of claim 10 wherein phosphor is located on the internal surface of the microsphere.

19. In a gas discharge display device, the improvement wherein the device is comprised of a multiplicity of microspheres located within one or more channels, grooves, cavities, wells, or hollows of said device, said channels, grooves, cavities, wells, or hollows of said device having side(s) or walls(s), phosphor located on said side(s) or wall(s), each microsphere containing an ionizable gas and secondary electron emission material, electrodes in proximity to each microsphere, and electronic circuitry means for providing voltages to selected electrodes so as to cause discharge of the gas within a selected microsphere and provide photons for the exciting of the phosphor and emission of light.

20. The invention of claim 19 wherein the electronic circuitry includes Address Display Separately architecture.

21. The invention of claim 19 wherein the electronic circuitry includes a slow ramp reset voltage.

22. The invention of claim 19 wherein the electronic circuitry includes an artifact reduction technique.

23. The invention of claim 19 wherein the ionizable gas contains phosphor particles.

24. The invention of claim 19 wherein phosphor is located on the internal surface of the microsphere.

25. The invention of claim 19 wherein each microspheres has a diameter of 2000 microns or less.

26. The invention of claim 19 wherein each microsphere has a diameter of 25 to 500 microns.

27. The invention of claim 19 wherein each microsphere has a diameter of 150 to 300 microns.

28. The invention of claim 19 wherein the gas is at a pressure below 760 Torr.

29. The invention of claim 19 wherein the gas is at a pressure above 760 Torr.

* * * * *